US010247151B2

(12) United States Patent
Koyama et al.

(10) Patent No.: US 10,247,151 B2
(45) Date of Patent: Apr. 2, 2019

(54) FUEL-TANK-EQUIPPED WORKING MACHINE

(71) Applicant: HONDA MOTOR CO., LTD., Tokyo (JP)

(72) Inventors: Hiroshi Koyama, Wako (JP); Masashi Kai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 85 days.

(21) Appl. No.: 15/447,278

(22) Filed: Mar. 2, 2017

(65) Prior Publication Data

US 2017/0260941 A1 Sep. 14, 2017

(30) Foreign Application Priority Data

Mar. 10, 2016 (JP) ..... 2016-047244

(51) Int. Cl.
*F02M 37/00* (2006.01)
*F02B 63/04* (2006.01)

(52) U.S. Cl.
CPC ..... *F02M 37/007* (2013.01); *F02B 63/048* (2013.01); *F02M 37/0076* (2013.01); *F02B 63/047* (2013.01); *F02B 2063/045* (2013.01); *F02B 2063/046* (2013.01)

(58) Field of Classification Search
CPC ..... F02M 37/007; F02M 37/0076; F02B 63/048; F02B 2063/045; F02B 2063/046; F02B 63/047
USPC ..... 123/195 C, 198 E, 198 P
See application file for complete search history.

(56) References Cited

U.S. PATENT DOCUMENTS 6,378,469 B1 * 4/2002 Hiranuma ..... F02B 63/04 123/195 C
2009/0322097 A1 * 12/2009 Hirose ..... F02B 63/04 290/1 A
2011/0017166 A1 * 1/2011 Schneiker ..... F02F 7/006 123/195 C

FOREIGN PATENT DOCUMENTS

JP 2005-133638 5/2005

* cited by examiner

*Primary Examiner* — Syed O Hasan
(74) *Attorney, Agent, or Firm* — Rankin, Hill & Clark LLP

(57) ABSTRACT

A fuel-tank-equipped working machine is provided, which is capable of securing a fuel tank to be large in a state where the fuel-tank-equipped working machine is secured to be compact. A generator 10 as a working machine includes a fuel tank 25 supported at an outer case 12. The working machine 10 includes a tank opening 35 that is formed at the outer case 12, a mounting concave portion 38 that is formed on the fuel tank 25, and a cushion portion 37 that is capable of being housed in the mounting concave portion 38. The tank opening 35 is formed so as to be able to expose an upper half part 25*a* of the fuel tank 25 to an outside 14 of the outer case 12. Further, the cushion portion 37 has a fitting groove 63 capable of being fitted to an opening rim 36 of the tank opening 35.

4 Claims, 7 Drawing Sheets

FUEL-TANK-EQUIPPED WORKING MACHINE

INCORPORATION BY REFERENCE

The present application claims priority under 35 U.S.C. § 119 to Japanese Patent Application No. 2016-047244 filed on Mar. 10, 2016. The content of the application is incorporated herein by reference in its entirety.

BACKGROUND OF THE INVENTION

Field of the Invention

The present invention relates to a fuel-tank-equipped working machine in which an engine is housed in an inside of an outer case, and fuel is supplied to the engine from the fuel tank.

Description of the Related Art

As a fuel-tank-equipped working machine, there is known a fuel-tank-equipped working machine in which the fuel tank is housed in an inside of an outer case, and a tank cap of the fuel tank is exposed to an outside of the outer case. The tank cap is removed from the outside of the outer case, and fuel can be supplied to an inside of the fuel tank (refer to Japanese Patent Laid-Open No. 2005-133638, for example.).

However, in the working machine in Japanese Patent Laid-Open No. 2005-133638, the fuel tank is housed in the inside of the outer case. Consequently, it is necessary to form the fuel tank to be smaller than an outer shape of the outer case.

Meanwhile, a working machine that is generally required in the market is such that the outer shape is formed to be compact and the fuel tank is formed to be large. However, since in the working machine in Japanese Patent Laid-Open No. 2005-133638, the fuel tank is housed in the inside of the outer case, it is difficult to secure the fuel tank to be large in the state in which the outer shape of the working machine is formed to be compact.

SUMMARY OF THE INVENTION

The present invention addresses a problem of providing a fuel-tank-equipped working machine that is capable of securing the fuel tank to be large in a state where the fuel-tank-equipped working machine is secured to be compact.

A first aspect of the present invention provides a fuel-tank-equipped working machine in which an engine is housed in an inside of an outer case, fuel is supplied to the engine from the fuel tank, and a working unit is driven by the engine, including a tank opening that is formed at the outer case, and allows a part of the fuel tank to be exposed to an outside of the outer case, a mounting concave portion that is formed into a concave shape by continuing to a peripheral wall of the fuel tank, along the tank opening, and a cushion portion that is formed to be capable of being housed in the mounting concave portion, and has a fitting groove capable of being fitted to a rim of the tank opening.

As above, the tank opening is formed in the outer case, and a part of the fuel tank is made capable of being exposed to the outside of the outer case from the tank opening. Consequently, a part of the fuel tank can be projected to the outside of the outer case. Thereby, the fuel tank can be formed to be large without making the shape of the outer case large. That is, in the state where the fuel-tank-equipped working machine is secured to be compact, the fuel tank can be secured to be large.

Further, the mounting concave portion is formed continuously along the tank opening, on the peripheral wall of the fuel tank. Furthermore, the cushion portion is made capable of being housed in the mounting concave portion, and the rim of the tank opening is made capable of fitted into the fitting groove of the cushion portion. Consequently, the fuel tank can be supported at the tank opening by housing the cushion portion in the mounting concave portion, and fitting the rim of the tank opening into the fitting groove of the cushion portion.

Consequently, by forming the mounting concave portions of many kinds of fuel tanks into the same shapes, many kinds of fuel tanks can be mounted to the same outer case. That is, a plurality of fuel tanks of appropriate capacities can be prepared in accordance with the use mode of the working machine, and convenience of the working machine can be enhanced.

Further, the cushion portion is housed in the mounting concave portion, and the rim of the tank opening is fitted in the fitting groove of the cushion portion, whereby the fuel tank can be supported at the tank opening. Consequently, fastening members such as bolts and nuts that are conventionally required can be made unnecessary, in order to mount the fuel tank to the outer case. Thereby, the weight of the fuel-tank-equipped working machine can be decreased.

Furthermore, the fastening members for mounting the fuel tank to the outer case are made unnecessary, whereby time and effort for mounting the fuel tank to the outer case can be saved.

In a second aspect of the present invention, the outer case is preferably divided into a plurality of cases, and the tank opening is preferably formed by the plurality of cases.

As above, the outer case is divided into a plurality of cases, and the tank opening is formed by the plurality of cases. Consequently, in the state where the cushion portion is housed in the mounting concave portion of the fuel tank, the rims of the plurality of cases can be fitted into the fitting groove of the cushion portion without much time and effort. Consequently, the fuel tank can be easily mounted to the rim of the tank opening.

In a third aspect of the present invention, the cushion portion is preferably formed into a ring shape.

As above, the cushion portion is formed into a ring shape, and thereby the cushion portion can be formed of a single member. Consequently, the cushion portion can be housed in the mounting concave portion of the fuel tank without much time and effort. Thereby, the fuel tank can be mounted to the rim of the tank opening more easily.

According to the present invention, the tank opening is formed at the outer case, and a part of the fuel tank is made capable of being exposed to the outside of the outer case from the tank opening. Thereby, the fuel tank can be secured to be large in the state where the fuel-tank-equipped working machine is secured to be compact.

DETAILED DESCRIPTION OF THE PREFERRED EMBODIMENT

Figure 1:
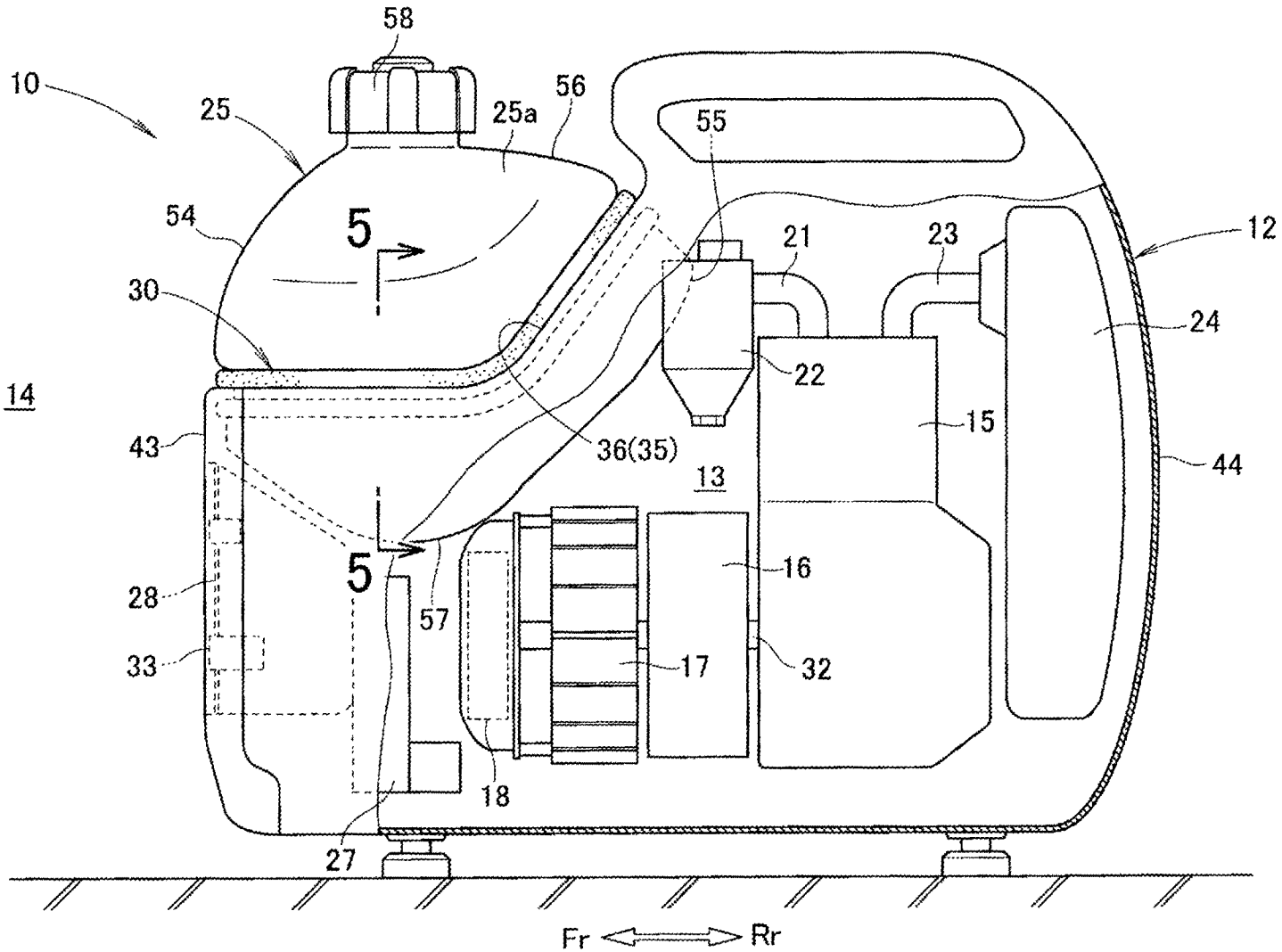
FIG. 1 is a side view illustrating a fuel-tank-equipped working machine according to the present invention.

A best mode for carrying out the present invention will be described hereinafter on the basis of the accompanying drawings.

Note that "a front (Fr)", "a rear (Rr)", "a left (L)" and "a right (R)" shown in the drawings are set based on an operation panel 28 side of a fuel-tank-equipped working machine 10 as the front (Fr).

Here, in an embodiment, the fuel-tank-equipped working machine 10 is illustrated as "a generator 10", but it is also possible to apply the fuel-tank-equipped working machine 10 to other working machines such as a mowing machine.

Embodiment

The fuel-tank-equipped working machine 10 according to the embodiment will be described.

As illustrated in FIG. 1, the generator 10 includes an outer case 12 that forms an outer frame of the generator 10, an engine 15 that is housed in an inside 13 of the outer case 12, a power generating unit (a working unit) 16 that is provided at a front side of the engine 15, a cooling fan 17 that is provided at a front side of the power generating unit 16, and a recoil starter 18 that is provided at a front side of the cooling fan 17.

Further, the generator 10 includes a carburetor 22 that connects to an intake port 21 of the engine 15, a muffler 24 that connects to an exhaust port 23 of the engine 15, a fuel tank 25 that is disposed in front of the engine 15, an inverter 27 that is provided under the fuel tank 25, an operation panel 28 that is provided on a front case 43 of the outer case 12, and tank support means 30 that supports the fuel tank 25 at the outer case 12.

According to the generator 10, the engine 15 drives by manually turning the recoil starter 18. The engine 15 drives, and thereby, a crankshaft 32 rotates. A rotor of the power generating unit 16 is connected to the crankshaft 32. Consequently, the rotor of the power generating unit 16 rotates by the crankshaft 32 rotating, and the power generating unit 16 drives.

The power generating unit 16 drives, whereby an electromotive force is generated in the rotor and a stator, and power generation is performed in the power generating unit 16. Direct-current power that is generated in the power generating unit 16 is converted into alternating-current power in the inverter 27, and power is supplied to an outside from a connector 33 at the operation panel 28.

Further, the cooling fan 17 is connected to the rotor of the power generating unit 16. Thereby, the cooling fan 17 rotates by the rotor of the power generating unit 16 rotating. The cooling fan 17 rotates, whereby outside air is sucked into the inside 13 from the outside 14 of the outer case 12, and the sucked outside air is sent to the engine 15 and the muffler 24 as cooling air. Thereby, the engine 15 and the muffler 24 can be cooled with the cooling air.

Figure 2:
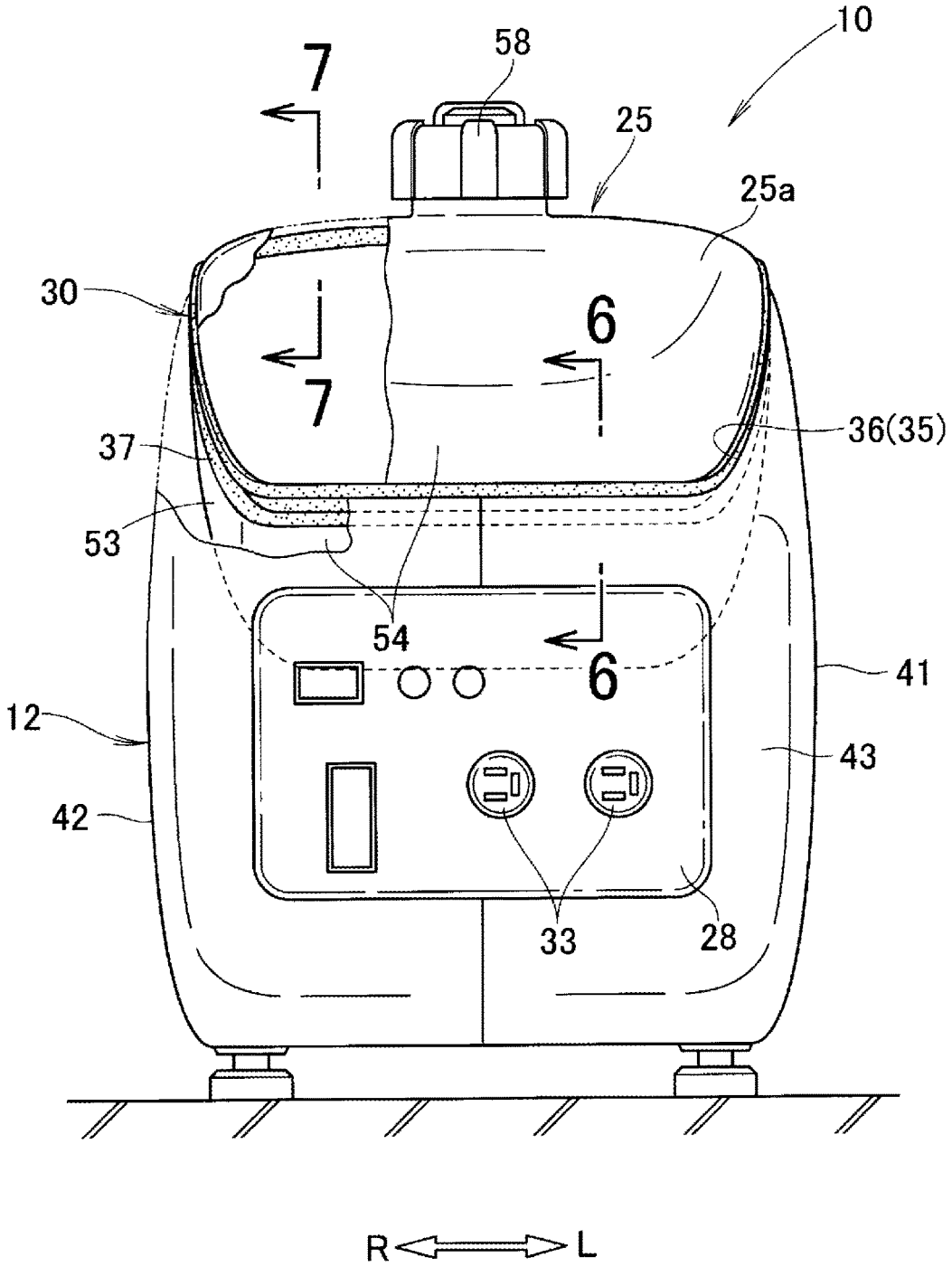
FIG. 2 is a front view illustrating the fuel-tank-equipped working machine in FIG. 1.

As illustrated in FIG. 2, the fuel tank 25 is supported at the outer case 12 with the tank support means 30. That is, the tank support means 30 includes, a tank opening 35 that is formed in the outer case 12, a cushion portion 37 that can be fitted to the tank opening 35, and a mounting concave portion 38 (refer to FIG. 3) that is formed on the fuel tank 25 and capable of housing the cushion portion 37. The tank opening 35 is formed to be substantially rectangular in plan view by an opening rim 36.

Figure 3:
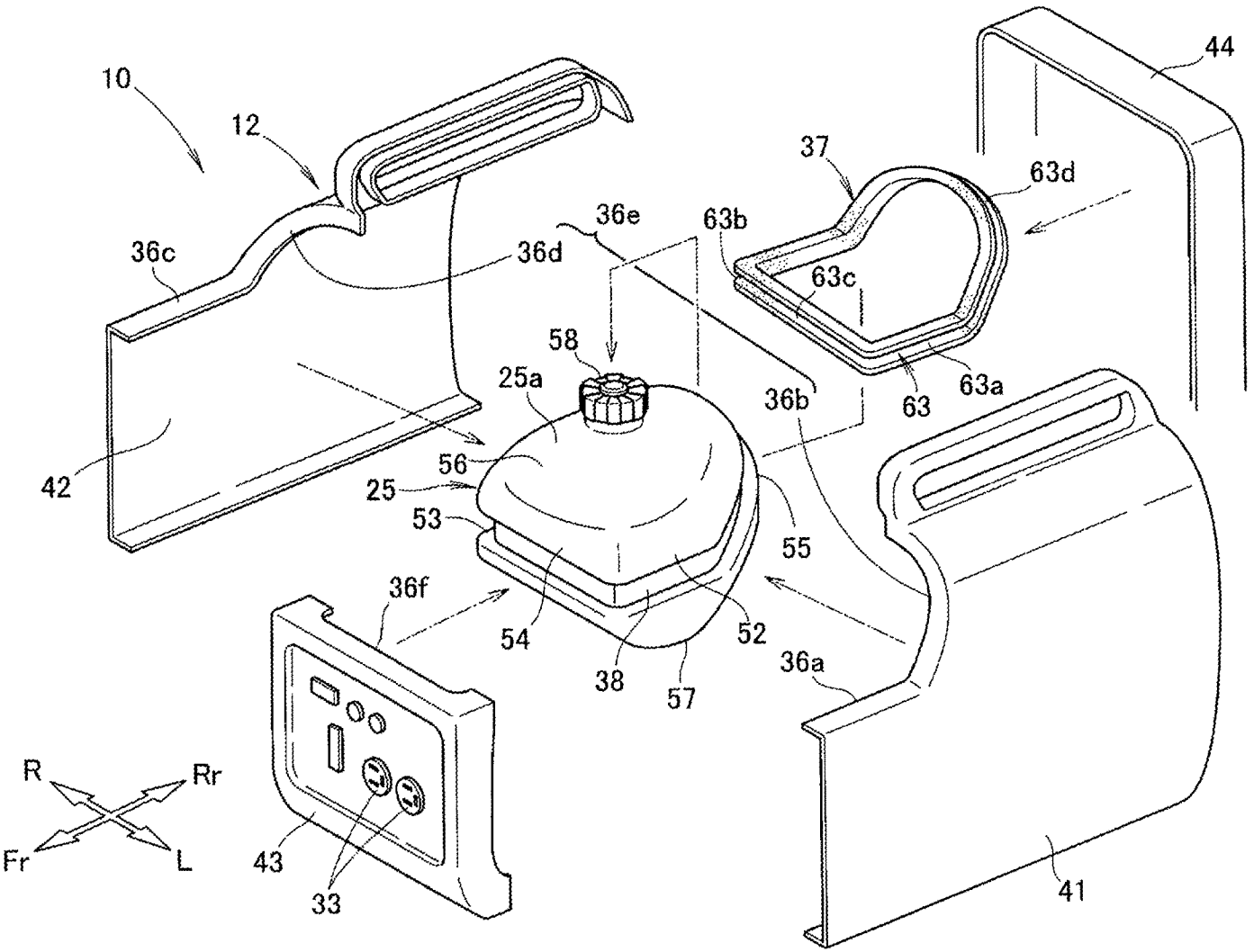
FIG. 3 is an exploded perspective view illustrating the fuel-tank-equipped working machine in FIG. 1.

As illustrated in FIG. 3, the outer case 12 is divided into a plurality of cases 41 to 44. That is, the outer case 12 includes a left case 41 that is disposed at a left side of the fuel tank 25, a right case 42 that is disposed at a right side of the fuel tank 25, a front case 43 that is disposed at a front side of the fuel tank 25, and a rear case 44 that is disposed at a rear side of the fuel tank 25.

The left case 41, the right case 42 and the front case 43 are assembled, and thereby the opening rim 36 (refer to FIG. 2, in addition) of the tank opening 35 is formed to be substantially rectangular in plan view. A left rim 36*a* and a rear left rim 36*b* of the opening rim 36 are formed at the left case 41. Further, a right rim 36*c* and a rear right rim 36*d* of the opening rim 36 are formed at the right case 42.

By the rear left rim 36*b* at the left case 41 and the rear right rim 36*d* at the right case 42, a rear rim 36*e* of the opening rim 36 is formed.

Further, a front rim 36*f* of the opening rim 36 is formed at the front case 43.

The left case 41, the right case 42 and the front case 43 are assembled, whereby the opening rim 36 of the tank opening 35 is formed by the left rim 36*a*, the right rim 36*c*, the front rim 36*f* and the rear rim 36*e* (that is, the rear left rim 36*b* and the rear right rim 36*d*).

As illustrated in FIG. 1, an upper half part (a part) 25*a* of the fuel tank 25 is projected upward from the tank opening 35. Thereby, the upper half part 25*a* of the fuel tank 25 is exposed to the outside 14 of the outer case 12.

Returning to FIG. 3, the fuel tank 25 includes a left wall portion 52 that faces the left case 41, a right wall portion 53 (refer to FIG. 2, in addition) that faces the right case 42, a front wall portion 54 that faces the front case 43, a rear wall portion 55 (refer to FIG. 1 in addition) that faces the rear case 44, a top portion 56 that connects upper sides of the respective wall portions 52 to 55, a bottom portion 57 (refer to FIG. 1 in addition) that connects lower sides of the respective wall portions 52 to 55, and a tank cap 58 that is detachably attached to an oil supply port at the top portion 56.

Figure 4:
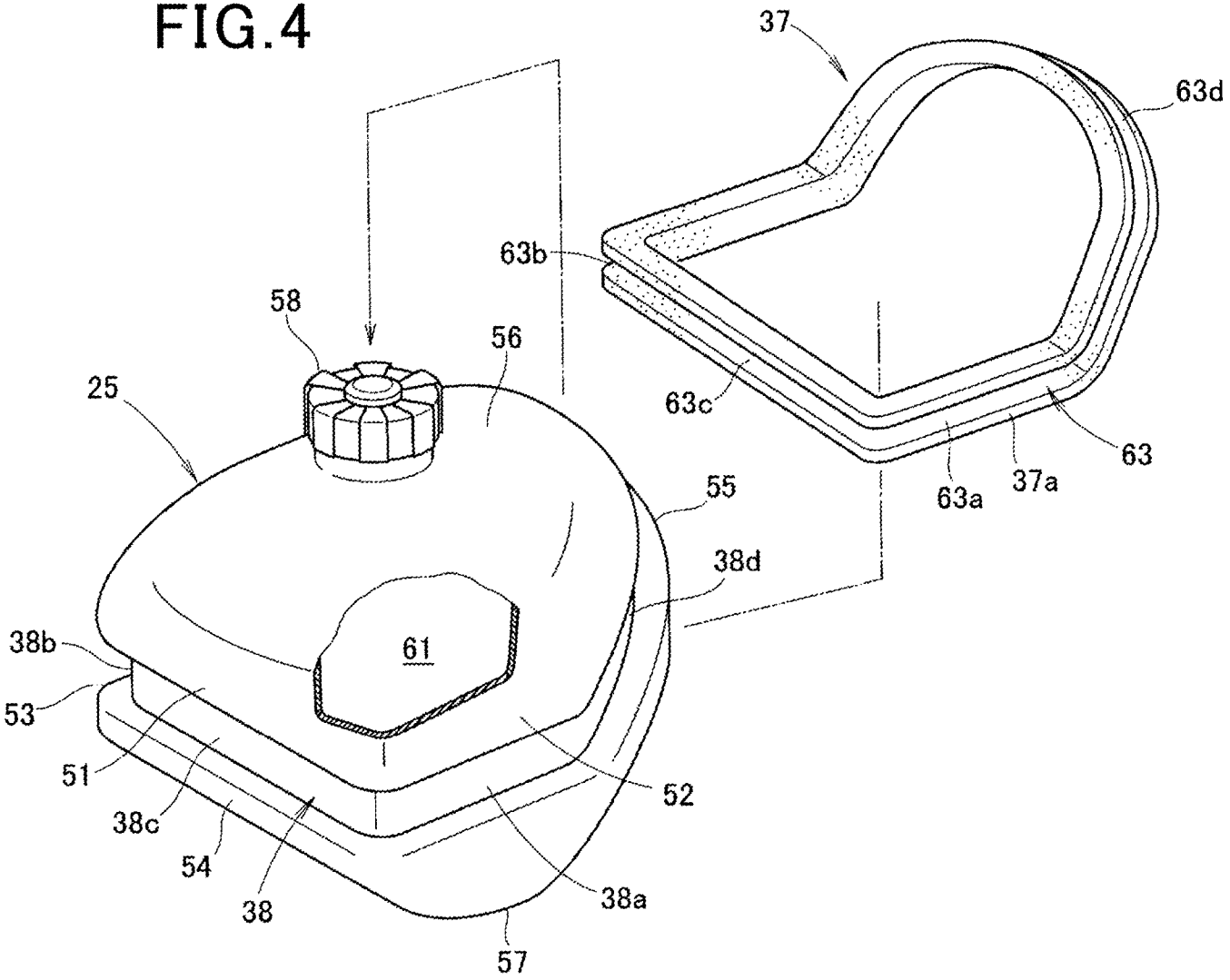
FIG. 4 is a perspective view illustrating the fuel tank and a cushion portion in FIG. 3.

As illustrated in FIG. 4, a peripheral wall 51 of the fuel tank 25 is formed into a shape of a substantially rectangular frame by the left wall portion 52, the right wall portion 53, the front wall portion 54 and the rear wall portion 55 of the fuel tank 25. The mounting concave portion 38 is formed on the peripheral wall 51 of the fuel tank 25.

The mounting concave portion 38 is formed into a ring shape by continuing to the peripheral wall 51 along the opening rim 36 (refer to FIG. 2) of the tank opening 35.

More specifically, the mounting concave portion 38 has a left mounting concave portion 38*a* that is formed on the left wall portion 52 of the fuel tank 25, a right mounting concave portion 38*b* that is formed on the right wall portion 53 of the fuel tank 25, a front mounting concave portion 38*c* that is formed on the front wall portion 54 of the fuel tank 25, and a rear mounting concave portion 38*d* that is formed on the rear wall portion 55 of the fuel tank 25.

Figure 5:
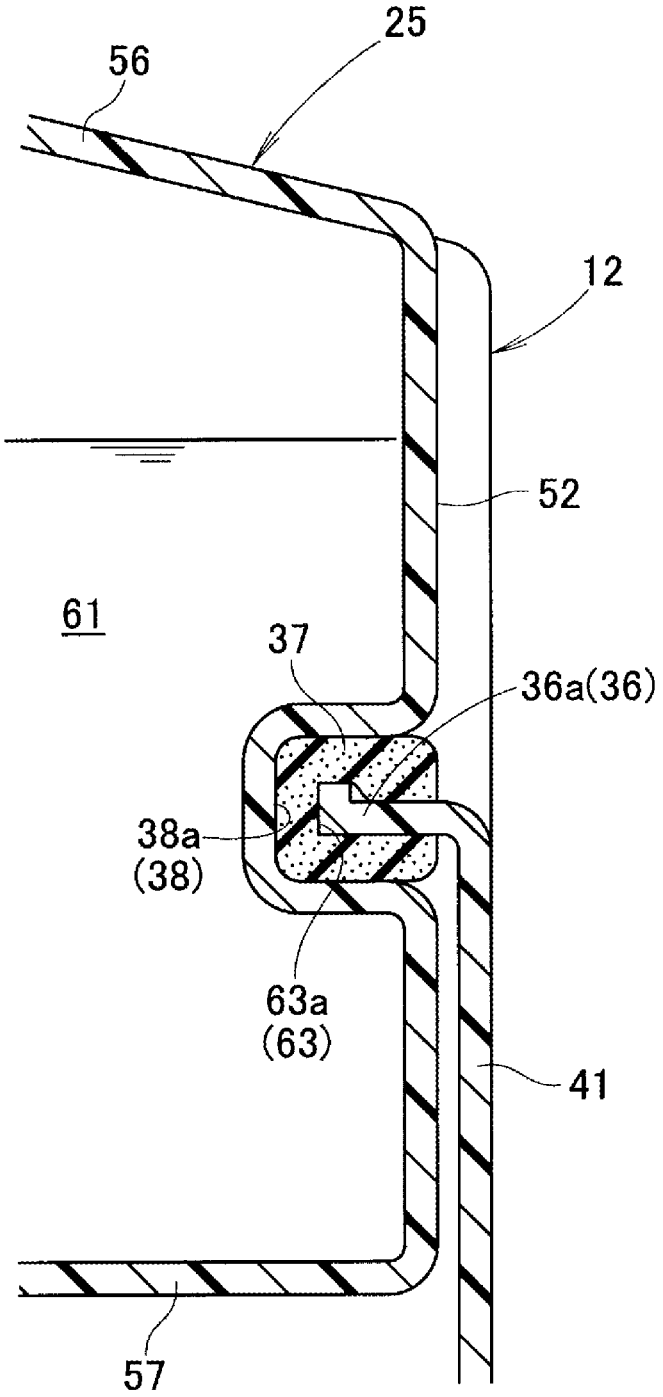
FIG. 5 is a sectional view taken along line 5-5 in FIG. 1.

The left mounting concave portion 38*a* of the left wall portion 52 is formed into a concave shape to be recessed substantially horizontally toward the inside 61 of the fuel tank 25 (refer to FIG. 5 in addition). Further, the right mounting concave portion 38*b* of the right wall portion 53 is a concave portion that is substantially laterally symmetrical to the left mounting concave portion 38*a*. That is, the right mounting concave portion 38*b* is formed into a concave shape to be recessed toward the inside 61 of the fuel tank 25.

Figure 6:
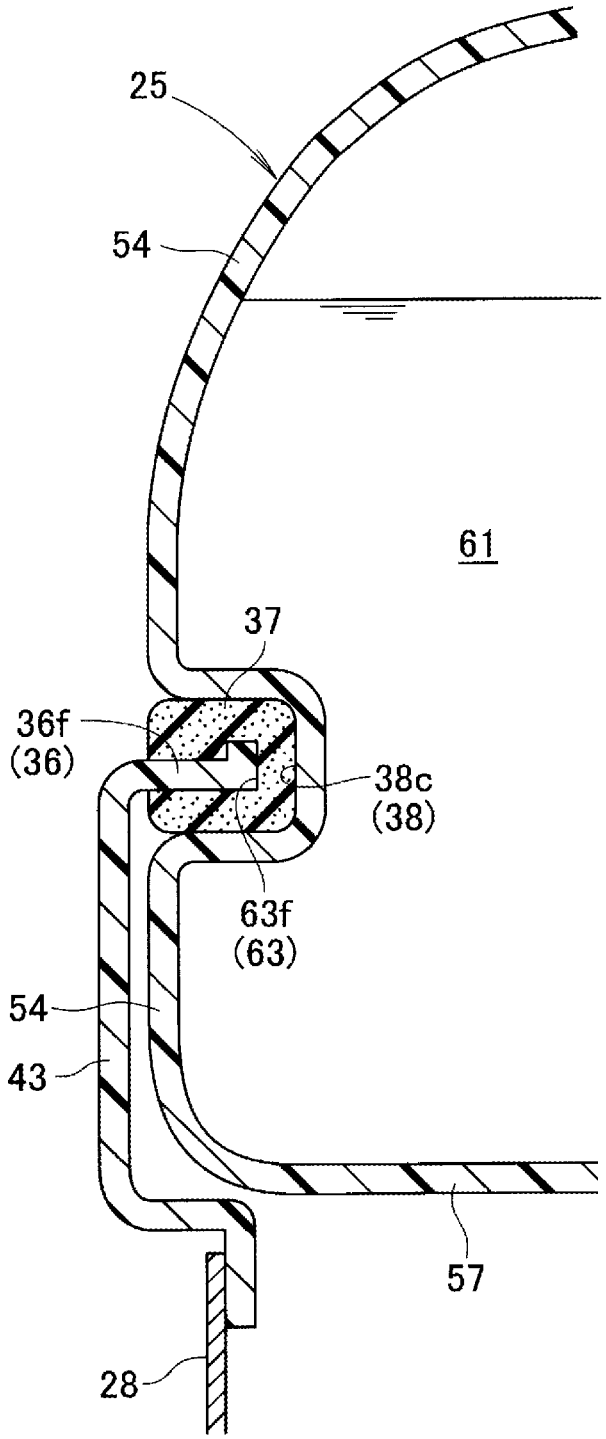
FIG. 6 is a sectional view taken along line 6-6 in FIG. 2.

Furthermore, the front mounting concave portion 38*c* of the front wall portion 54 is formed into a concave shape to be recessed substantially horizontally toward the inside 61 of the fuel tank 25, similarly to the left mounting concave portion 38*a* and the right mounting concave portion 38*b* (refer to FIG. 6 in addition).

A left end portion of the front mounting concave portion 38*c* is connected to a front end portion of the left mounting concave portion 38*a*. Further a right end portion of the front mounting concave portion 38*c* is connected to a front end portion a front end portion of the right mounting concave portion 38*b*.

Figure 7:
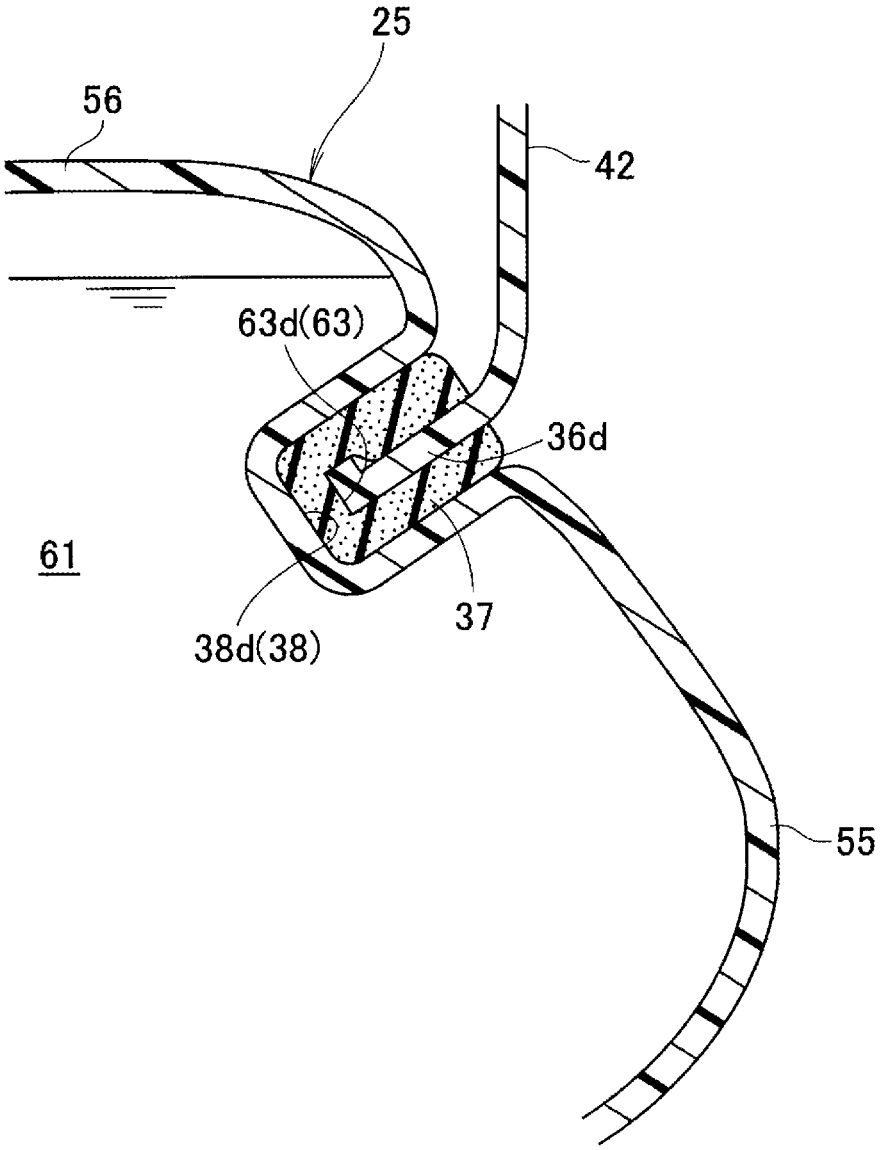
FIG. 7 is a sectional view taken along line 7-7 in FIG. 2.

Further, the rear mounting concave portion 38*d* of the rear wall portion 55 is formed into a concave shape to be recessed with a falling gradient toward the inside 61 of the fuel tank 25 (refer to FIG. 7 in addition)

A left end portion of the rear mounting concave portion 38*d* is connected to a rear end portion of the left mounting concave portion 38*a*. Further, a right end portion of the rear mounting concave portion 38*d* is connected to a rear end portion of the left mounting concave portion 38*a*.

That is, the mounting concave portion 38 is formed to be substantially rectangular ring-shaped in plan view by the left mounting concave portion 38*a*, the right mounting concave portion 38*b*, the front mounting concave portion 38*c*, and the rear mounting concave portion 38*d*. The cushion portion 37 is housed in the ring-shaped mounting concave portion 38.

The cushion portion 37 is formed into substantially rectangular ring-shaped in plan view along the mounting concave portion 38 of the fuel tank 25, from an elastically deformable material such as a rubber material. Therefore, the cushion portion 37 is housed in the mounting concave portion 38.

The cushion portion 37 has a fitting groove 63 that is formed into a ring shape in an outer peripheral wall 37*a*. The fitting groove 63 is formed to be capable of being fitted to the opening rim 36, along the opening rim 36 of the tank opening 35.

More specifically, the fitting groove 63 has a left fitting groove 63*a*, a right fitting groove 63*b*, a front fitting groove 63*c* and a rear fitting groove 63*d*. The left fitting groove 63*a*, the right fitting groove 63*b*, the front fitting groove 63*c* and the rear fitting groove 63*d* are continuously connected, whereby the fitting groove 63 is formed into a ring shape.

Here, in a state where the cushion portion 37 is housed in the mounting concave portion 38, the left fitting groove 63*a* is housed in the left mounting concave portion 38*a* of the mounting concave portion 38. Further, the right fitting groove 63*b* is housed in the right mounting concave portion 38*b* of the mounting concave portion 38.

Further, the front fitting groove 63*c* is housed in the front mounting concave portion 38*c* of the mounting concave portion 38. Further, the rear fitting groove 63*d* is housed in the rear mounting concave portion 38*d* of the mounting concave portion 38.

As illustrated in FIG. 3, the left rim 36*a* of the opening rim 36 (refer to FIG. 2) is fitted into the left fitting groove 63*a* from a left side. Further, the right rim 36*c* of the opening rim 36 is fitted into the right fitting groove 63*b* from a right side.

Further, the front rim 36*f* of the opening rim 36 is fitted into the front fitting groove 63*c* from a front side. Further, the rear rim 36*d* of the opening rim 36 is fitted into the rear fitting groove 63*d* from an upper rear side.

As illustrated in FIG. 5, in a state where the left fitting groove 63*a* is housed in the left mounting concave portion 38*a*, the left fitting groove 63*a* is formed to be recessed substantially horizontally toward the inside 61 of the fuel tank 25. The left rim 36*a* is fitted into the left fitting groove 63*a* from the left side.

Returning to FIG. 4, the right fitting groove 63*b* is a part that is formed to be substantially laterally symmetrical to the left fitting groove 63*a*. In a state where the right fitting groove 63*b* is housed in the right mounting concave portion 38*b*, the right fitting groove 63*b* is formed to be recessed substantially horizontally toward the inside 61 of the fuel tank 25, similarly to the left fitting groove 63*a*. The right rim 36*c* is fitted into the right fitting groove 63*b* from a right side.

As illustrated in FIG. 6, in a state where the front fitting groove 63*c* is housed in the front mounting concave portion 38*c*, the front fitting groove 63*c* is formed to be recessed substantially horizontally toward the inside 61 of the fuel tank 25, similarly to the left fitting groove 63*a* and the right fitting groove 63*b* (refer to FIG. 4). The front rim 36*f* of the opening rim 36 is fitted into the front fitting groove 63*c* from a front side.

As illustrated in FIG. 7, in a state where the rear fitting groove 63*d* is housed in the rear mounting concave portion 38*d*, the rear fitting groove 63*d* is formed to be recessed with a falling gradient toward the inside 61 of the fuel tank 25. The rear rim 36*d* of the opening rim 36 is fitted into the rear fitting groove 63*d* from the upper rear side.

Consequently, as illustrated in FIG. 3, in the state where the cushion portion 37 is housed in the mounting concave portion 38, the opening rim 36 of the tank opening 35 is fitted into the fitting groove 63 of the cushion portion 37. Thereby, the fuel tank 25 is supported at the outer case 12 with the tank support means 30.

Accordingly, the mounting concave portions 38 of many kinds of fuel tanks 25 are formed into the same shapes, whereby many kinds of fuel tanks 25 can be mounted to the same outer case 12. That is, a plurality of fuel tanks 25 of appropriate capacities can be prepared in accordance with the use modes of the generator 10 (refer to FIG. 1 in addition), and convenience of the generator 10 can be enhanced.

Further, the fuel tank 25 is supported by using the mounting concave portion 38, the cushion portion 37 and the opening rim 36, and thereby, fastening members such as bolts and nuts that are conventionally needed, in order to mount the fuel tank 25, can be made unnecessary. Thereby, the weight of the generator 10 can be decreased.

Furthermore, by making the fastening members for mounting the fuel tank 25 to the outer case 12 unnecessary, the time and effort for mounting the fuel tank 25 to the outer case 12 can be saved.

Further, by assembling the left case 41, the right case 42 and the front case 43 that are obtained by dividing the outer case 12, the opening rim 36 of the tank opening 35 is formed by the left rim 36*a*, the right rim 36*c*, the front rim 36*f* and the rear rim 36*e*.

Consequently, in the state where the cushion portion 37 is housed in the mounting concave portion 38 of the fuel tank 25, the opening rim 36 can be fitted into the fitting groove 63 of the cushion portion 37 without much time and effort. Thereby, the fuel tank 25 can be easily mounted to the opening rim 36 of the tank opening 35.

Further, by forming the cushion portion 37 into a ring shape, the cushion portion 37 can be formed of a single member. Consequently, the cushion portion 37 can be housed in the mounting concave portion 38 of the fuel tank 25 without much time and effort.

Thereby, the fuel tank 25 can be mounted to the opening rim 36 of the tank opening 35 more easily.

Returning to FIGS. 1 and 2, in the state where the fuel tank 25 is supported by the tank support means 30, the upper half part 25*a* of the fuel tank 25 is projected from the tank opening 35. Consequently, the fuel tank 25 can be formed to be large without making the shape of the outer case 12 large.

Thereby, the fuel tank 25 can be secured to be large in the state where the generator 10 is secured to be compact.

Note that the fuel-tank-equipped working machine according to the present invention is not limited to the aforementioned embodiment, and can be properly modified, and altered.

For example, the shapes and the configurations of the generator, the outer case, the engine, the power generating unit, the fuel tank, the tank opening, the opening rim, the cushion portion, the mounting concave portion, the left, right, front and rear cases, the peripheral wall and the fitting groove of the fuel tank and the like that are shown in the aforementioned embodiment are not limited to the shapes and the configurations that are illustrated, but can be properly changed.

The present invention is suitable for application to the fuel-tank-equipped working machine in which the engine is housed in the inside of the outer case, fuel is supplied to the engine from the fuel tank, and the working unit is driven by the engine.

REFERENCE SIGNS LIST

10 Generator (fuel-tank-equipped working machine)
12 Outer case
13 Inside of outer case
14 Outside of outer case
15 Engine
16 Power generating unit (working unit)
25 Fuel tank
25*a* Upper half part of fuel tank (part of fuel tank)
35 Tank opening
36 Opening rim
37 Cushion portion
38 Mounting concave portion
41 to 44 Left, right, front and rear cases (a plurality of cases)
51 Peripheral wall of fuel tank
63 Fitting groove

What is claimed is:

1. A fuel-tank-equipped working machine in which an engine is housed in an inside of an outer case, fuel is supplied to the engine from a fuel tank, and a working unit is driven by the engine, comprising:

a tank opening that is formed by the outer case, and allows a part of the fuel tank to be exposed to an outside of the outer case;

a mounting concave portion provided by the fuel tank, said mounting concave portion being formed into a concave shape so as to be recessed toward an inside of the fuel tank, continuing to a peripheral wall of the fuel tank, and extending along the tank opening; and a cushion portion that is formed to be capable of being received in the mounting concave portion, said cushion portion having an outer peripheral wall flush with the peripheral wall of the fuel tank in a state where the cushion portion is received in the mounting concave portion, and having a fitting groove capable of being fitted to a rim of the tank opening in the outer case.

2. The fuel-tank-equipped working machine according to claim 1, wherein the outer case is divided into a plurality of cases, and the tank opening is formed by the plurality of cases.

3. The fuel-tank-equipped working machine according to claim 1, wherein the cushion portion is formed into a ring shape.

4. The fuel-tank-equipped working machine according to claim 2, wherein the cushion portion is formed into a ring shape.

* * * * *